United States Patent [19]

Koiso et al.

[11] 4,300,757

[45] Nov. 17, 1981

[54] APPARATUS FOR RECEIVING RECORDING SHEETS IN UPSET STATE FOR COPYING MACHINE

[75] Inventors: Junichi Koiso; Hiroko Ito, both of Hachioji, Japan

[73] Assignee: Konishiroku Photo Industry Co., Ltd., Tokyo, Japan

[21] Appl. No.: 88,359

[22] Filed: Oct. 26, 1979

[30] Foreign Application Priority Data

Oct. 31, 1978 [JP] Japan ..... 53/149661[U]

[51] Int. Cl.[3] ..... B65H 31/00

[52] U.S. Cl. ..... 271/207; 271/186; 355/3 SH; 355/133

[58] Field of Search ..... 355/133, 3 R, 3 SH, 355/75; 271/207, 186, 224, 65

[56] References Cited

U.S. PATENT DOCUMENTS

| | | | |
|---|---|---|---|
| 3,154,356 | 10/1964 | Lewis et al. | 271/207 |
| 3,617,053 | 11/1971 | Menard | 271/207 X |
| 4,155,643 | 5/1979 | Ladds et al. | 271/207 X |
| 4,220,323 | 9/1980 | Smith | 271/207 X |

OTHER PUBLICATIONS

*IBM Tech. Disc. Bull.*, "Copied Sheet Sequence Reverser", vol. 20, No. 4, Sep., 1977, p. 1592.

*IBM Tech. Disc. Bull.*, "Copy Inverting Tray", vol. 4, No. 3, May/Jun., 1979, p. 317.

*Primary Examiner*—Richard L. Moses

*Attorney, Agent, or Firm*—Bierman & Bierman

[57] ABSTRACT

An apparatus for collecting copy sheets in facially reversed or overturned relation with respect to their discharge from a copying machine includes a guide member disposed proximate the discharge port of the machine. The guide member comprises a substantially planar guide portion inclined at a predetermined angle relative to the direction of copy sheet discharge from the machine, and a deflecting portion unitarily extending from the guide portion at a predetermined angle with respect thereto. The apparatus further includes a receiving tray spaced below the discharge port and toward which discharged copy sheets are deflected by contact with the guide and deflecting portions of the guide member for collection in overturned or face reversed orientation.

8 Claims, 9 Drawing Figures

APPARATUS FOR RECEIVING RECORDING SHEETS IN UPSET STATE FOR COPYING MACHINE

BACKGROUND OF THE INVENTION

1. Field of the Invention

The present invention relates to an apparatus for receiving or collecting in facially reversed orientation copying sheets discharged from a copying machine.

2. Description of the Prior Art

In hitherto known copying machines, the recording or copying sheets are generally discharged from the copying apparatus in such manner that the surface of the copying sheet on which image information is recorded faces upward as discharged. Consequently, a plurality of the copied sheets collected in a stack on a receiving tray with the recorded surface facing upward will be superposed in reverse order relative to the copying sequence as counted from the top of the sheet stack. Accordingly, when a book or the like is copied, the book must be copied in reverse order starting from the last page in order to avoid having to later rearrange the pages.

Is an attempt to overcome the inconvenience described above, there has been proposed an apparatus for collecting the copying sheets discharged from the copying machine in an upset or reverse face position so that the recorded face of the copying sheets face relatively downward. For example, reference is made to Japanese Utility Model Publication No. 31747/1968, where the prior art apparatus is so arranged that the leading edge of the copying sheet as discharged from the copying machine is caused to bear against a stopper projecting from a guide plate to thereby turn over or facially reverse the discharged sheet. However, this arrangement has associated disadvantages in that its use is restricted to a specific type of copying sheet, since some sheets—depending upon the size and stiffness or rigidity of the sheets—will not be caught by the stopper projection. Furthermore, the prior art structure provides for copy sheet discharge by way of a moving conveyor, and face reversing contact of the sheet leading edge with the projecting stopper has a tendency to disorder the received and collected sheets, thus interfering with and rendering more troublesome subsequent removal of the stacked copy sheets from the collecting tray.

SUMMARY OF THE INVENTION

In view of the drawbacks of the prior art apparatus of the sheet upsetting or face reversing type described above, an object of the present invention is to provide a copied sheet collecting apparatus for a copying machine which is capable of collecting the copied sheets discharged from the copying machine in an orderly, stacked and upset or reverse face state.

In the following, the invention will be described in detail by referring to the accompanying drawings showing an exemplary embodiment thereof.

DETAILED DESCRIPTION OF THE PREFERRED EMBODIMENT

Figure 1:
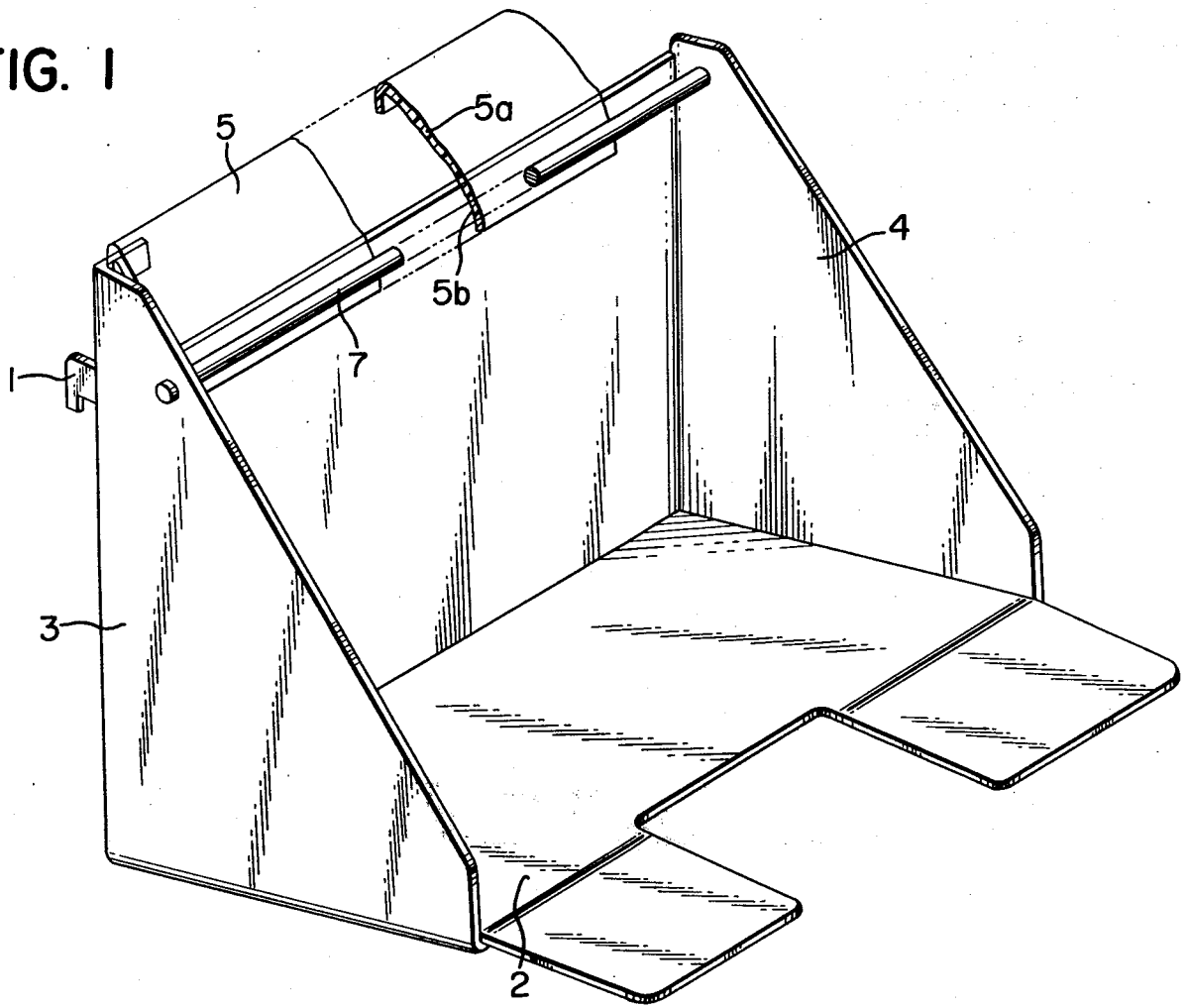
FIG. 1 is an elevated perspective view showing a general structure of a sheet receiving or collecting tray according to the present invention.
Figure 2:
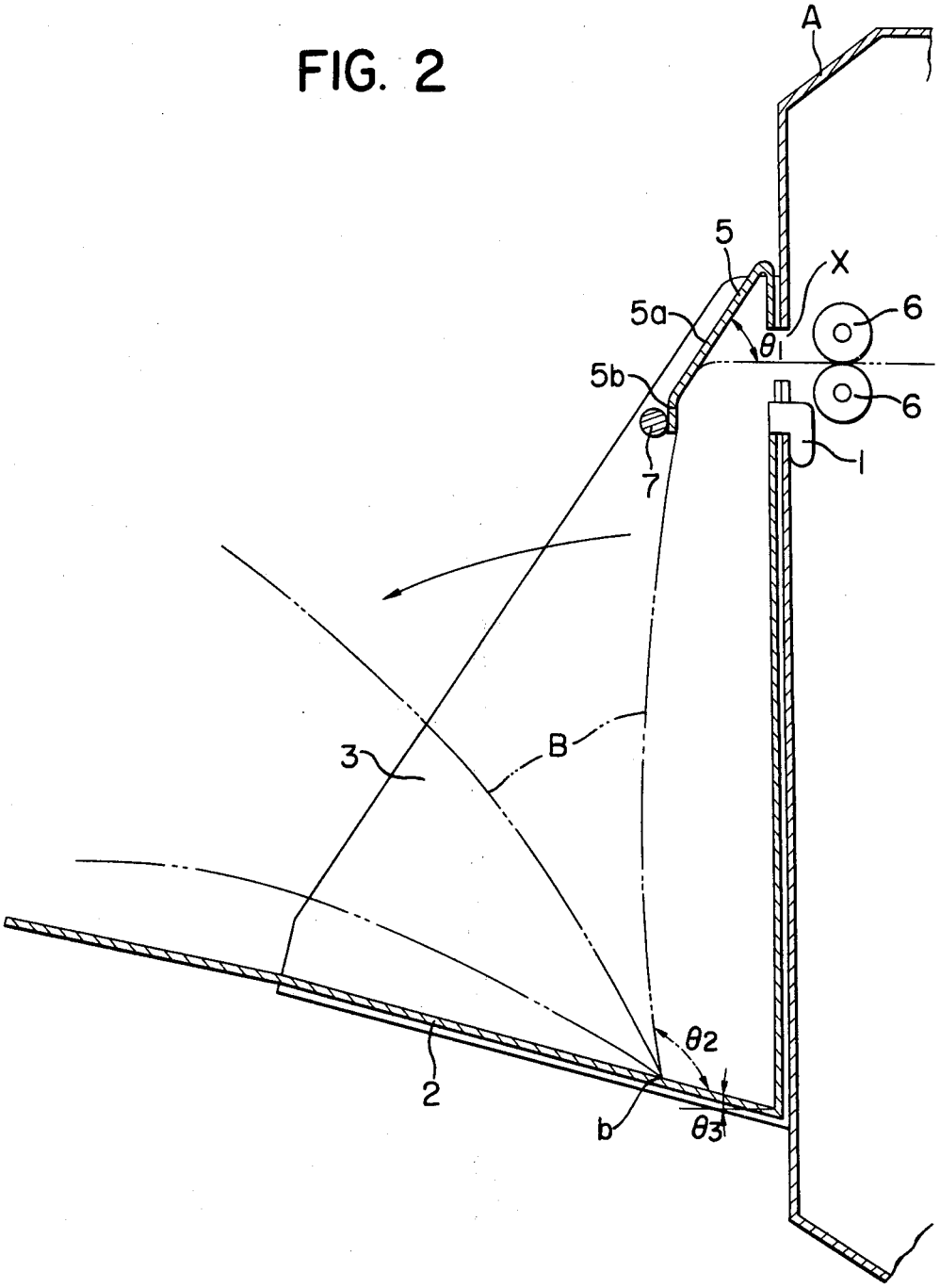
FIG. 2 is an end sectional view of the same shown mounted on a copying apparatus.
Figure 3A:
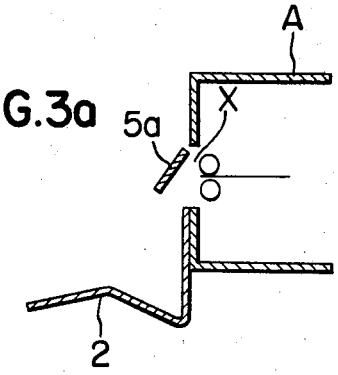
FIGS. 3(*a*) to 3(*g*) illustrate various modifications or alternative emobdiments of the present invention.
Figure 3B:
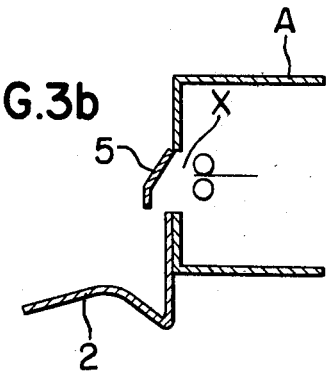
Figure 3C:
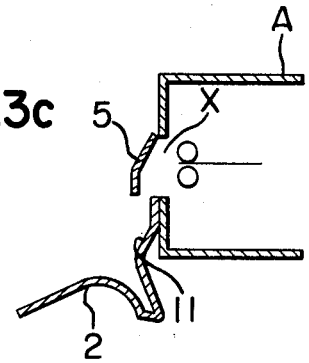
Figure 3D:
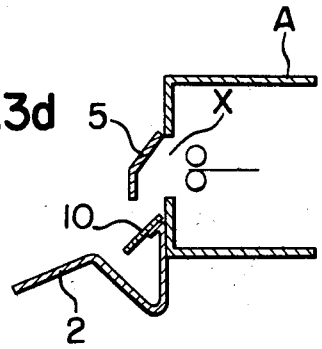
Figure 3E:
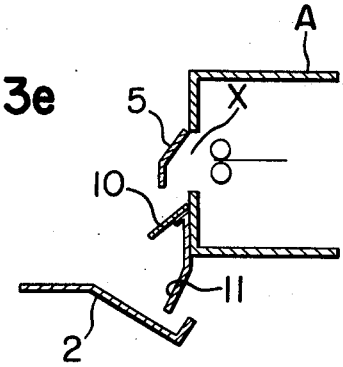
Figure 3F:
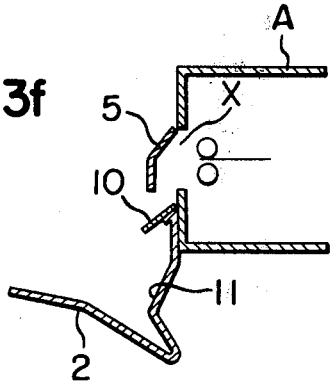
Figure 3G:
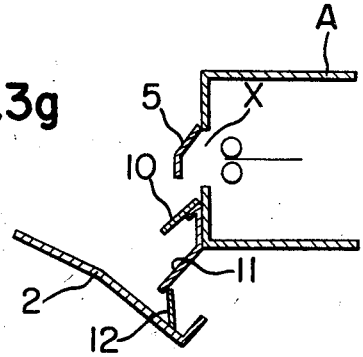

FIGS. 1 and 2 show a sheet collecting tray of a type which can be removably or detachably coupled to a copying machine by means of hooks 1 so as not to interfere with or obstruct a sheet exhaust or discharge port X of the machine. The collecting tray comprises a receiving means or tray 2 for collecting thereon the copying sheet B, side plates 3 and 4, and a guide means or guide member 5 mounted at the top ends of side plates 3 and 4. The free end of receiving tray 2 is inclined upwardly with respect to its supported dependency on the machine body. Guide member 5 may be so configured and mounted in opposition to discharge port X that the leading edge of the copying sheet discharged through a pair of discharge rollers 6 is forcedly caused to be deflected downwardly. In the case of the illustrated embodiment, guide member 5 is constituted by a guide portion 5*a* inclined at an angle of $\theta_1$ relative to the discharging direction of the copied sheet and a deflecting portion 5*b* formed contiguous to guide portion 5*a* at an angle with respect thereto. In this embodiment, the distance between the lower end of the guide member and the lower end of the sheet receiving tray substantially corresponds to the length of the smallest size copying sheet to be used. Experimentally, it has been found that satisfactory results can be obtained when the parameter $\theta_1$ of guide member 5 formed of a acryl resin is selected to approximate an angle of 35°, while deflecting portion 5*b* extends therefrom in a substantially vertical direction. It should be noted with respect to this embodiment that guide member 5 is preferably formed of a transparent material having a low frictional coefficient and that guide member 5 is rigidly secured to side plates 3 and 4 by means of a reinforcing rod 7. By making use of transparent material for the guide member, jamming of the copied sheet at the discharge port X may be visibly detected, while the recorded image on the copying sheet can be checked before reversal of the upwardly disposed face of the copying sheet. In addition, the guide member serves as a handle for facilitating the transportation of the collecting tray as well as its attachment to and removal from a copying machine.

The general characteristic features of the present invention are clearly set forth in the claims. In preferred embodiments of the present invention, however, it has been experimentally confirmed that the desired purpose can be attained without fail when an angle $\theta_3$ at which the receiving tray is inclined with respect to the horizontal is selected no smaller than an angle of approximately 25° for a copying sheet of a normal or common size and stiffness. $\theta_2$ represents an angle formed between the upper surface of receiving tray 2 and the leading edge portion b of a copying sheet B as shown in FIG. 2. Although the upper surface of receiving tray 2 is illustrated at an upwardly inclined position, tray 2 may be disposed in a horizontal position or in a position inclined slightly downward in consideration of the bending characteristics of the deflected copying sheet.

With the structure of the recording or copying sheet receiving apparatus according to the invention as described above, a copying sheet B discharged from discharge port X of a copying machine is deflected downwardly by means of guide member 5. After the leading edge b of copying sheet B has reached the upper surface of receiving tray 2, it is reversed or turned over in the direction indicated by an arrow (no reference symbol) in FIG. 2 by its own continuing, sequential movement in accordance with the copying operation. As will be appreciated from the above description and FIG. 2, the copying or copied sheet is transported to guide portion 5*a* of guide member 5 in such condition that the copied surface is facing upwardly. At the same time, the sheet is discharged horizontally from discharge port X of the copying machine.

FIGS. 3(*a*) to 3(*g*) illustrate various modifications of the sheet receiving apparatus for a copying machine according to the present invention in which the same or similar parts to those shown in FIG. 2 are denoted by identical reference symbols. More particularly, for a copying sheet having relatively little stiffness or rigidity, a guide portion 5*a* from which deflecting part 5*b* is omitted may be employed, as is illustrated in FIG. 3(*a*). Further, with a view to stacking the copying sheets in an orderly manner, configurations such as those illustrated in FIGS. 3(*a*) to 3(*g*) may be imparted to receiving tray 2 depending upon the stiffness of the copying sheets to be used. That is to say, the plate forming the receiving tray is bent in the manner shown. Further still, in order to assure sticking of the leading edge of the copying sheet to the upper surface of receiving tray 2, a plate 10 formed of flexible material such as polyester film may be disposed below guide member 5, as is shown in FIGS. 3(*d*) to 3(*g*). Alternatively, a guide surface 11 may be formed immediately below guide member 5 as shown in FIGS. 3(*c*), 3(*e*), 3(*f*) and 3(*g*) to guide the leading edge of the copying sheet which is curled in the direction of the copying machine wall seen in the illustrated embodiments. Additionally, for a significantly curled copying sheet, a movable plate 12 urged in the direction to correct the curl may be provided on the receiving tray, as is shown in FIG. 3(*g*).

In the case of the illustrated embodiments, the guide members 5 of the geometrical configurations described above are assumed to be used. However, it will be readily appreciated that each such guide member 5 may be replaced by or used in combination with another type guide means as, for example, an air nozzle adapted to eject compressed air streams.

Thus, it will now be further appreciated that the copy sheet receiving apparatus of the face reversing type according to the present invention can assure the face reversal or overturning of copying sheet discharged from a copying apparatus independently of restrictions such as to size and stiffness or rigidity of the copying sheets and thereby allow them to be collected in an orderly manner without misalignment due to a curled state of the sheets or like causes, whereby removal of the stacked copying sheets can be effected in a greatly facilitated manner.

The guide member need not necessarily be provided close to the discharge port X but may be located at a desired distance from the latter, in which case the copied image can be easily checked.

It goes without saying that an important purpose of the present invention resides in causing a copying sheet to be collected in the overturned or face reversed position, and stacking of the sheets in the proper order of pages is merely an advantageous side effect of this purpose.

What we claim is:

1. A sheet receiving apparatus for collecting in facially reversed orientation copy sheets discharged from a discharge port of a copying machine, said apparatus comprising:

sheet receiving means spaced below the machine discharge port for collecting the discharged copy sheets in facially reversed orientation; and guide means proximate the discharge port for downwardly deflecting discharged copy sheets toward said sheet receiving means, said guide means comprising a unitary structure formed of a substantially planar guide portion inclined at a predetermined angle with respect to the direction of discharge of copy sheets from the machine and into which the copy sheets are deflectingly driven on discharge from the copying machine, and a deflecting portion unitarily extending from said guide portion at a predetermined angle with respect thereto so that the copy sheets deflected by said guide portion are thereafter further deflected by said deflecting portion to direct the copy sheets toward said sheet receiving means.

2. A sheet receiving apparatus in accordance with claim 1, wherein the distance between said guide means and said sheet receiving means is substantially equal to the length of the copy sheets along the direction of their discharge from the copying machine.

3. A sheet receiving apparatus in accordance with claim 1, said predetermined angle at which said guide portion is inclined with respect to the discharge direction of copy sheets from the machine being approximately 35°.

4. A sheet receiving apparatus in accordance with claim 1, said sheet receiving means comprising a receiving tray extending outwardly from the copying machine at a relatively upwardly-inclined angle therefrom.

5. A sheet receiving apparatus in accordance with claim 1 and further comprising a flexible plate disposed intermediate said guide means and said sheet receiving means for facilitating facially reversed collection on said sheet receiving means of discharged copy sheets deflected by said guide means.

6. A sheet receiving apparatus in accordance with claim 1 and further comprising means for releasably coupling said apparatus to the copying machine proximate its discharge port.

7. A sheet receiving apparatus in accordance with claims 1 or 3, wherein said deflecting portion extends substantially vertically from said guide portion in the direction of said sheet receiving means.

8. A sheet receiving apparatus in accordance with claim 4, wherein the angle at which said receiving tray is upwardly inclined is approximately 25°.

* * * * *